US011411346B2

(12) United States Patent
Fang et al.

(10) Patent No.: US 11,411,346 B2
(45) Date of Patent: Aug. 9, 2022

(54) ELECTRICAL CONNECTOR HAVING POSITION HOLDER

(71) Applicant: APTIV ELECTRICAL CENTERS (SHANGHAI) CO., LTD., Shanghai (CN)

(72) Inventors: Chao Fang, Shanghai (CN); Zhaofei Ma, Shanghai (CN); Weiguo Jiang, Shanghai (CN); Zengliang Yu, Shanghai (CN); Anyang Zhang, Shanghai (CN); Wenzheng Ma, Shanghai (CN); Selvin Berlin Anand, Shanghai (CN)

(73) Assignee: APTIV ELECTRICAL CENTERS (SHANGHAI) CO., LTD., Shanghai (CN)

( * ) Notice: Subject to any disclaimer, the term of this patent is extended or adjusted under 35 U.S.C. 154(b) by 89 days.

(21) Appl. No.: 16/957,209

(22) PCT Filed: Dec. 27, 2018

(86) PCT No.: PCT/CN2018/124405
§ 371 (c)(1),
(2) Date: Jun. 23, 2020

(87) PCT Pub. No.: WO2019/129149
PCT Pub. Date: Jul. 4, 2019

(65) Prior Publication Data

US 2022/0006236 A1 Jan. 6, 2022

(30) Foreign Application Priority Data

Dec. 28, 2017 (CN) ..... 201711461106.1

(51) Int. Cl.
*H01R 13/629* (2006.01)
*H01R 13/502* (2006.01)
*H01R 13/639* (2006.01)

(52) U.S. Cl.
CPC ..... *H01R 13/62955* (2013.01); *H01R 13/502* (2013.01); *H01R 13/6295* (2013.01); *H01R 13/639* (2013.01)

(58) Field of Classification Search
CPC ..... H01R 13/62933; H01R 13/639; H01R 13/641; H01R 13/62955; H01R 13/502; H01R 13/6295
(Continued)

(56) References Cited

U.S. PATENT DOCUMENTS 6,824,406 B1 * 11/2004 Sharples ..... H01R 13/62977 439/157
8,784,127 B2 * 7/2014 Bashkin ..... H01R 13/62944 439/372
(Continued)

FOREIGN PATENT DOCUMENTS

CN 1180254 A 4/1998
CN 1768457 A 5/2006
(Continued)

OTHER PUBLICATIONS

International Search Report and Written Opinion dated Jul. 4, 2019.
(Continued)

*Primary Examiner* — Gary F Paumen
(74) *Attorney, Agent, or Firm* — Billion & Armitage

(57) ABSTRACT

An electrical connector comprises: a housing provided with a locking portion; a locking lever, which has a first arm and a second arm connected to opposite sides of the housing, and a beam portion extending between the first arm and the second arm, with a channel being provided in the beam
(Continued)

portion; and a connector position assurance member, the connector position assurance member having a locking edge, the connector position assurance member being inserted into the channel from an open end of the channel, and the connector position assurance member having a pre-installed position and a locked position in the channel, wherein when the locking lever pivots to the second position and the connector position assurance member enters into the locked position, the locking edge abuts against the locking portion in the channel, thereby locking a rotational motion of the locking lever.

18 Claims, 4 Drawing Sheets

(58) Field of Classification Search
USPC ..... 439/372, 157, 489
See application file for complete search history.

(56) References Cited

U.S. PATENT DOCUMENTS

2004/0192090 A1 9/2004 Flowers et al.
2005/0106911 A1* 5/2005 Sharples ..... H01R 13/62977 439/157
2006/0211286 A1* 9/2006 Shuey ..... H01R 13/641 439/157
2007/0099461 A1* 5/2007 Pittenger ..... H01R 13/62977 439/157
2007/0197071 A1* 8/2007 Patterson ..... H01R 13/62955 439/157
2011/0212644 A1* 9/2011 Itzenhuiser ..... H01R 13/62955 439/352
2014/0154910 A1* 6/2014 Conway ..... H01R 13/5213 439/358
2015/0079830 A1 3/2015 Iwatani
2015/0200487 A1 7/2015 Pade
2016/0099520 A1* 4/2016 Papurcu ..... H01R 13/62955 439/752

FOREIGN PATENT DOCUMENTS

CN 101044660 A 9/2007
CN 102460847 A 5/2012
CN 103490228 A 1/2014
CN 204464633 U 7/2015
CN 105846242 A 8/2016
CN 206098930 U 4/2017
CN 106898920 A 6/2017
CN 206259561 U 6/2017

OTHER PUBLICATIONS

Extended European Search Report for EP Application No. 18896263.3, dated Aug. 20, 2021, 10 pages.

* cited by examiner

ELECTRICAL CONNECTOR HAVING POSITION HOLDER

The present application is a national stage filing of PCT/CN2018/124405, filed Dec. 27, 2018, which claims priority under 35 U.S.C. § 119 to CN Patent Application No. 201711461106.1, filed Dec. 28, 2017.

TECHNICAL FIELD

The present invention relates to an electrical connector, and more particularly to an electrical connector with a position assurance member.

BACKGROUND

In the technical field of electrical connection, a lever-type locking system has been used for electrically connecting mating parts of an electrical device together.

The lever-type electrical connection system generally has two electrical connection members mating with each other, one of which is provided with a pivoting lever, and when the two electrical connection members are engaged together, the lever pivots to a locked position, and the lever enables the two electrical connection members to be relatively locked in a fitting position. In addition, the electrical connection system is further provided with a position retaining member, and the position retaining member is used to lock the position of the lever, thereby ensuring that the electrical connection members that fit together will not be disengaged so as to further improve the connection reliability of the electrical connection system.

These electrical connection systems are widely applied in various vehicles. However, due to the limited narrow installation space in the vehicle, the assembly of the existing lever-locked electrical connection systems is often limited by the environment. Therefore, there is still a need to improve the existing lever-type electrical connection system such that it can be more flexibly applied in a limited space environment.

SUMMARY

To overcome the shortcomings of the prior art, the present invention provides an electrical connector, comprising: a housing, with a locking portion provided thereon; a locking lever pivotally mounted on the housing, the locking lever pivoting between a first position and a second position, and the locking lever having a first arm and a second arm connected to opposite sides of the housing and a beam portion extending between the first arm and the second arm, with a channel being provided in the beam portion; and a connector position assurance member, the connector position assurance member having a locking edge, the connector position assurance member being inserted into the channel from an open end of the channel, and the connector position assurance member having a pre-installed position and a locked position in the channel, wherein when the locking lever pivots to the second position and the position assurance member enters into the locked position, the locking edge abuts against the locking portion in the channel, thereby locking a rotational motion of the locking lever.

According to one aspect of the present invention, the channel has a top, a bottom, and two open side ends, and the connector position assurance member is optionally inserted from either of the two open side ends.

According to another aspect of the present invention, the bottom of the channel has an opening, and when the locking lever pivots to the second position, the locking portion is received into the channel through the opening.

According to yet another aspect of the present invention, the connector position assurance member has two locking edges arranged in an opposite manner, each of the locking edges comprises a notch, and when the connector position assurance member is in the pre-installed position in the channel, one of the notches is aligned with the locking portion and receives the locking portion.

According to yet another aspect of the present invention, a top side of the connector position assurance member has a mounting portion, and the top of the channel is provided with a mounting hole that fits with the mounting portion. A bottom side of the connector position assurance member is provided with an elastic holding portion, the bottom of the channel has a limiting portion and an avoidance portion, when the connector position assurance member is in the pre-installed position, the elastic holding portion is fitted into the limiting portion, and when the connector position assurance member moves to the locked position, the elastic holding portion is fitted into the avoidance portion.

According to yet another aspect of the present invention, the housing is provided with a trigger protrusion, and when the locking lever with the connector position assurance member rotates to the second position and the connector position assurance member is in the pre-installed position, the trigger protrusion is received into the limiting portion and abuts against the elastic holding portion, such that the elastic holding portion moves out of the limiting portion.

According to yet another aspect of the present invention, the housing is provided with two trigger protrusions, and the two trigger protrusions are symmetrically arranged with respect to the locking portion.

According to yet another aspect of the present invention, two avoidance portions are provided, the avoidance portions are symmetrically arranged on two sides of the limiting portion with respect to the limiting portion, and the avoidance portions and the limiting portion are arranged on a straight line.

Further, one end of the connector position assurance member is provided with a tab as an operation portion. The other end thereof, as an insertion end, can flexibly insert through the channel end.

According to the present invention, the connector position assurance member is substantially entirely accommodated in the channel of the lever, with the position where the locking edge of the connector position assurance member is in contact with the locking portion being also in the channel of the beam portion of the locking lever. Therefore, the connector has a compact structure without increasing the peripheral size thereof.

In the present invention, both ends of the channel of the locking lever are open, with the mounting hole, the limiting portion and the avoidance portion therein being all symmetrically arranged with respect to the center line of the channel, and the trigger protrusions being also symmetrically arranged on the housing of the connector. In this way, the connector position assurance member can be optionally inserted from either end of the channel, and one corresponding trigger protrusion on the housing can abut against the elastic holding portion on the bottom side of the connector position assurance member so as to trigger the movement of the connector position assurance member from the pre-installed position to the locked position. The flexibility of installation of the connector position assurance member is greatly improved. Especially in a narrow space, such as in a vehicle, the direction of insertion of the connector position assurance member can be changed at will according to the actual use environment of the electrical connector.

Both the trigger protrusions and the locking portion are received inside the channel, which is thus possible to avoid the failure of these parts due to accidental touch.

REFERENCE NUMERALS

10 Electrical connector
20 Mating connector
101 Housing
103 Locking lever
1031 Pivot hole
1032 Channel
1033 Mounting hole
1034 Limiting portion
1035 Avoidance portion
1037 Opening
1038 Sliding groove
1039 Arm
1036 Beam portion
201 Locking pin
1011 Trigger protrusion
1012 Locking portion
1013 Pivot
102 Connector position assurance member
1021 Locking edge
1022 Notch
1023 Mounting portion
1024 Elastic holding portion
1025 Tab

DETAILED DESCRIPTION

The present invention will be further described below in conjunction with particular embodiments and the accompanying drawings, and more details are explained in the following description for the ease of fully understanding the present invention; however, the present invention can obviously be implemented in various different manners than that described herein, a person skilled in the art can make an similar extension and deduction without departing from the connotation of the present invention according to the practical applications, and therefore the scope of protection of the present invention should not be limited to the content of the particular embodiments herein.

Figure 1:
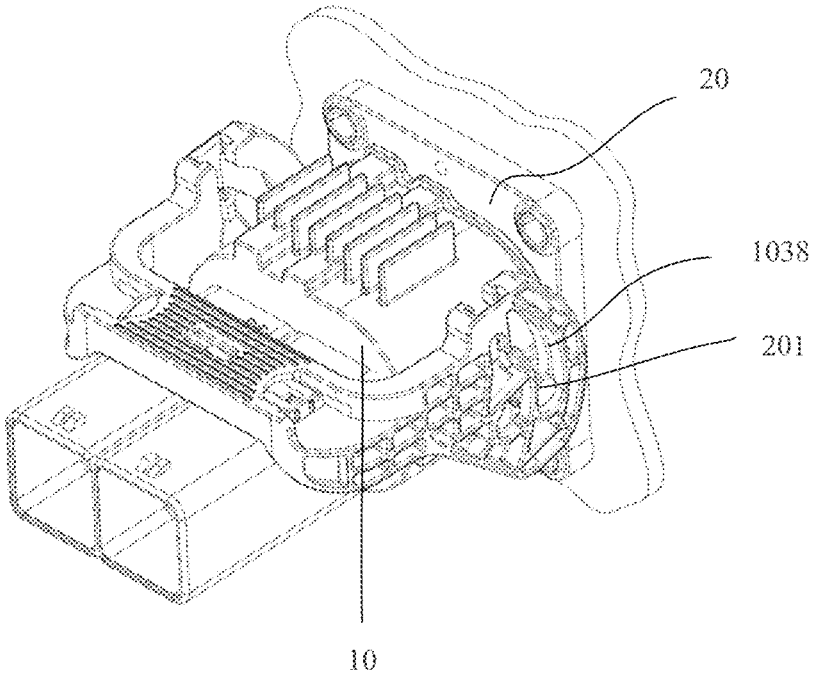
FIG. 1 shows a perspective view of an electrical connector according to the present invention, with the connector being connected to a mating male connector.

As shown in FIG. 1, an electrical connector 10 with a locking lever 103 according to the present invention is engaged with a mating connector 20. In this embodiment, the electrical connector 10 is a female connector, and the mating connector 20 is a male connector, and when they fit together, the locking lever 103 on the electrical connector 10 locks positions of two connectors 10, 20 by means of mating of a sliding groove 1038 and a locking pin 201. The locking lever 103 shown in FIG. 1 is in a position where the connectors are locked.

Figure 2:
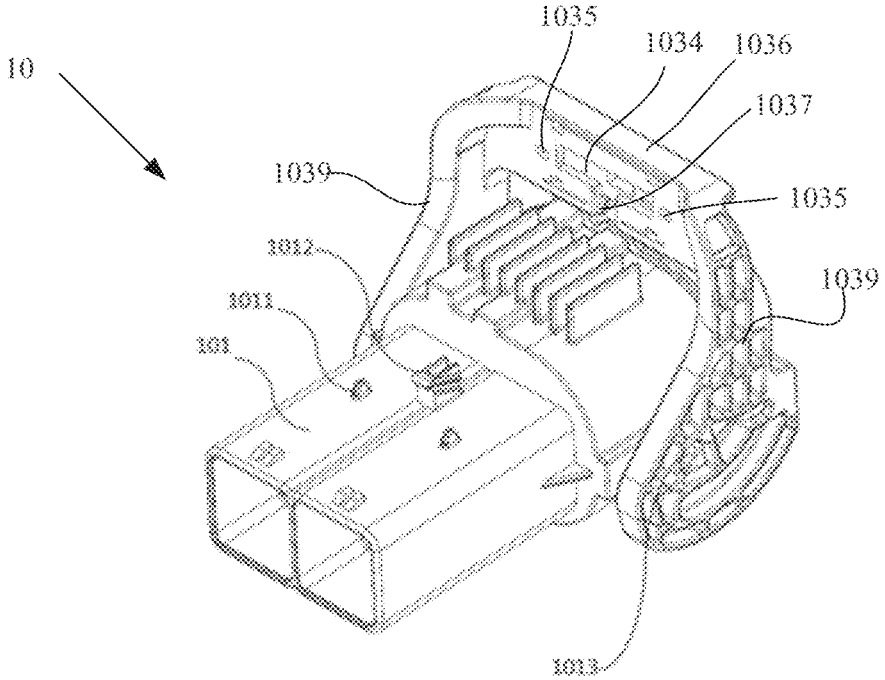
FIG. 2 shows a perspective view of an electrical connector according to the present invention.

The locking lever 103 of the electrical connector 10 is mounted onto a housing 101 of the electrical connector 10 by means of a pivot structure, and as shown in FIGS. 1 and 2, the locking lever 103 pivots between two positions. FIG. 2 shows that the locking lever 103 is in a first position where the two connectors 10, 20 are released, and FIG. 1 shows that the locking lever 103 is in a second position where the two connectors 10, 20 are locked.

As shown in FIG. 2, the locking lever 103 is substantially U-shaped, and has a first arm 1039, a second arm 1039, and a beam portion 1036 extending between the first arm 1039 and the second arm 1039. Ends of the first arm 1039 and the second arm 1039 have pivot holes 1031, and the pivot holes 1031 fit to a pivot 1013 provided on the housing 101, thereby constructing a pivot structure to achieve the pivoting motion of the locking lever 103. An end of the locking lever 103 is provided with a sliding groove 1038, and the sliding groove 1038 slidably fits with the locking pin on the mating connector 20, so as to achieve the locking between the two connectors 10, 20.

Figure 3:
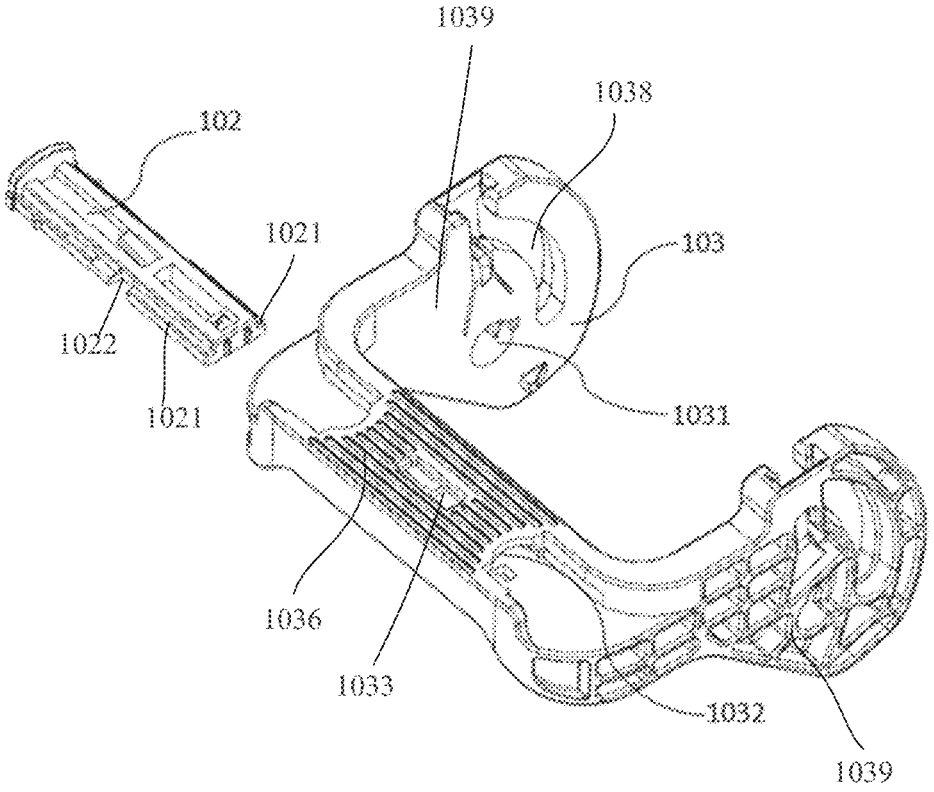
FIG. 3 shows an exploded perspective view of a locking lever and a connector position assurance member.

According to an embodiment of the present invention, the locking lever 103 is particularly provided with a connector position assurance member 102, as shown in FIG. 3, used to ensure that the locking lever 103 is held in the position shown in FIG. 1. As shown in FIG. 3, the connector position assurance member 102 in an embodiment of the present invention is substantially elongated, is generally integrally molded, and is inserted into a channel 1032 formed on the beam portion 1036 of the locking lever 103, and by means of the fitting between a locking edge 1021 of the connector position assurance member 102 and a locking portion 1012 on the housing 101 (see FIG. 2), the connector position assurance member 102 can ensure the position of the locking lever 103. In some embodiments, the locking portion 1012 is configured as a protrusion standing on a surface of the housing, and is provided, on the top thereof, with a snap-in portion to engage with the locking edge 1021, that is, the locking edge 1021 of the connector position assurance member 102 is inserted between the snap-in portion and the surface of the housing 101.

Figure 6:
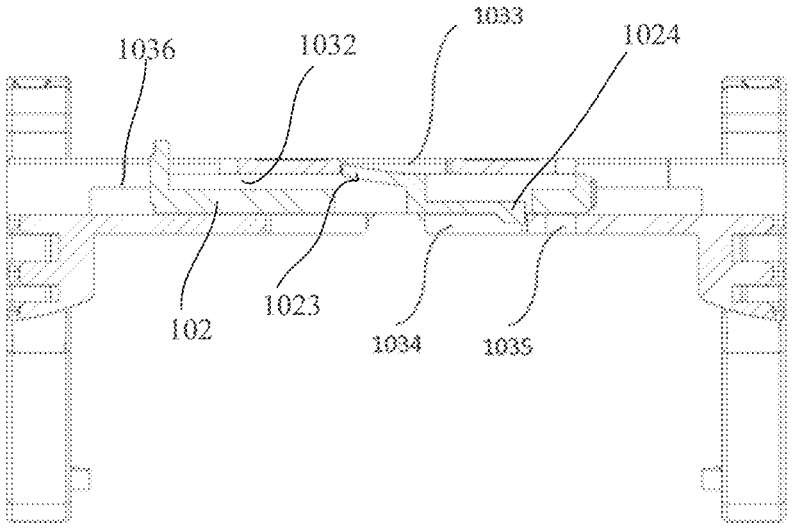
FIG. 6 shows a cross-sectional view of the locking lever with a connector position assurance member inserted therein, with the connector position assurance member being in a pre-installed position.

The connector position assurance member 102 has two positions in the channel 1032: a pre-installed position and a locked position. When the connector position assurance member 102 is in the pre-installed position, as shown in FIG. 6, the connector position assurance member 102 is held in the channel 1032 of the beam portion 1036, and the locking lever 103 pivots relative to the housing. When the locking lever 103 reaches the position shown in FIG. 1, the connector position assurance member 102 can move within the channel 1032 to reach the locked position shown in FIG. 7, where the locking edge 1021 of the connector position assurance member 102 abuts against the locking portion 1012 on the housing, thereby locking the locking lever 103 in its second position.

Referring to FIGS. 2, 3, 6 and 7, the channel 1032 of the locking lever 103 has a top, a bottom, and two opposite open ends, and the connector position assurance member 102 can be inserted from either of the two ends. Also, the top of the channel 1032 has a mounting hole 1033. The bottom of the channel 1032 has an opening 1037 for receiving the locking portion 1012, and a limiting portion 1034 and an avoidance portion 1035 which fit with the connector position assurance member 102. In the embodiment, the mounting hole 1033 at the top is elongated, and it is centrally arranged in the top of the channel. As shown in FIG. 2, preferably, the opening 1037 and the limiting portion 1034 are integrally formed on the bottom, centrally arranged at the bottom of the channel 1032, and two avoidance portions 1035 are provided and are respectively arranged on two sides of the limiting portion 1034. The avoidance portions 1035 and the limiting portion 1034 are formed on a straight line.

In this embodiment, the limiting portion 1034 is an elongated hole centrally arranged at the bottom of the beam portion 1036, and the avoidance portion is a square hole mating with an elastic holding portion 1024.

As an alternative, the limiting portion 1034 may also be configured in another form, such as two symmetrically arranged square holes. In addition, the opening 1037 receiving the locking portion 1012 and the limiting portion 1034 receiving the elastic holding portion 1024 may also be independently arranged at the bottom of the channel 1032.

Figure 4:
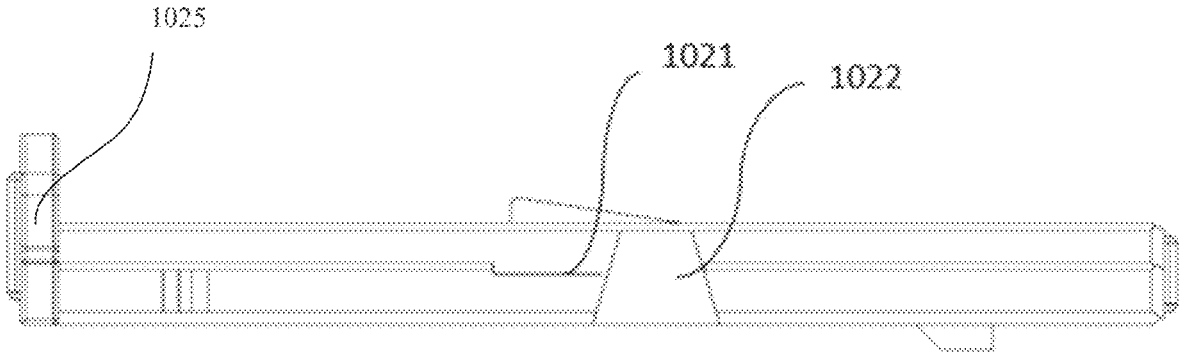
FIG. 4 shows a front view of the connector position assurance member.
Figure 5:
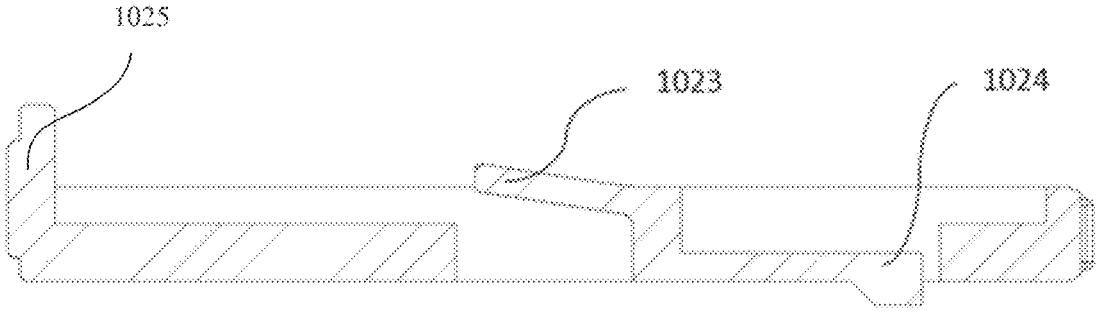
FIG. 5 shows a cross-sectional view of the connector position assurance member.

Referring to FIGS. 3-5, the connector position assurance member 102 has two locking edges 1021 arranged in an opposite manner, each of the locking edges 1024 comprises a notch 1022 as an avoidance structure, and in some embodiments, the notch 1022 is centrally arranged in the edge 1021. A top side of the connector position assurance member 102 has a mounting portion 1023 that fits into the mounting hole of the channel 1032 and protrudes from the top side surface, and preferably, a rising slope is formed in a direction of insertion of the connector position assurance member 102. In some embodiments, the mounting portion 1023 is entirely received in the mounting hole 1033 and does not protrude from the outer surface of the top of the channel 1032, such that the outer surface of the top of the channel is a substantially flat surface. A bottom side of the connector position assurance member 102 is provided with the elastic holding portion 1024. The elastic holding portion 1024 is, for example, in the form of an elastic beam, and the elastic holding portion 1024 slightly protrudes from the outer surface of the bottom side of the connector position assurance member 102. In the pre-installed position, the elastic holding portion 1024 is engaged with the limiting portion 1034 in the bottom of the beam portion 1036, and when in the locked position, the elastic holding portion 1024 is fitted into the avoidance portion 1035.

In addition, one end of the connector position assurance member 102 is provided with a tab 1025, as an operation portion, suitable for being pushed by an operator with a finger.

In addition, as can be seen from FIG. 2, the housing of the electrical connector 10 is further provided with two trigger protrusions 1011, and the two trigger protrusions 1011 are symmetrically arranged with respect to the locking portion. The trigger protrusion 1011 is configured to push the elastic holding portion 1024 of the connector position assurance member 102 out of the limiting portion 1034 so as to move into the avoidance portion 1035, thereby being able to further move from the pre-installed position to the locked position.

Figure 7:
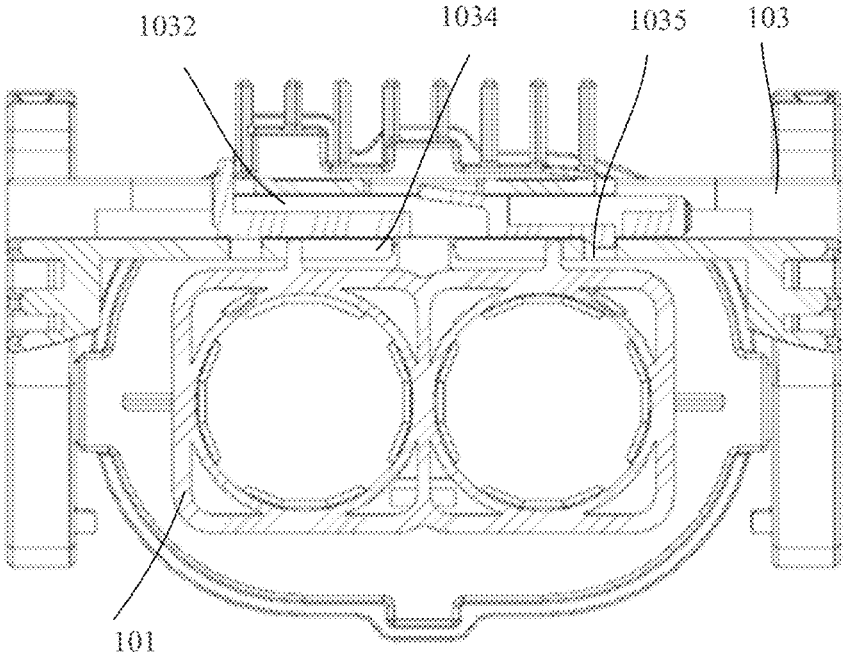
FIG. 7 shows a perspective view of the electrical connector according to the present invention, with the connector position assurance member being in a locked position.

Next, the locking operation of the electrical connector 10 of the present invention will be described in detail with reference to FIGS. 6 and 7.

Before the two connectors 10, 20 are mated, the locking lever 103 is in the first position as shown in FIG. 2. Subsequently, the two connectors 10 and 12 are plugged together, and at this moment, the locking pin 201 on the mating connector is received into the sliding groove 1038 on the end of the locking lever 103. The locking lever 103 rotates to the second position as shown in FIG. 1 in a direction towards the locking portion 1012, thereby locking the locking pin 201 in the sliding groove 1038.

At this moment, the connector position assurance member 102 may have been inserted into the pre-installed position of the channel 1032 of the beam portion 1036. FIG. 6 shows a cross section of the beam portion 1036 mounted with the connector position assurance member 102 in the pre-installed position. As can be seen from FIG. 6, the mounting portion 1023 at the top side of the connector position assurance member 102 is received in the mounting hole 1033 at the top of the channel 1032. When the connector position assurance member 102 is in the pre-installed position, the notch 1022 in the locking edge 1021 of the connector position assurance member 102 is aligned with the locking portion 1012. As the locking lever 103 rotates, the locking portion 1012 enters the channel 1032 from the opening 1037 at the bottom of the channel 1032 and is inserted into the notch 1022 of the connector position assurance member 102.

When the locking lever 103 rotates to the second position, the trigger protrusion 1011 on the housing 101 is received into the limiting portion 1034 at the bottom of the channel 1032 and abuts against the elastic holding portion 1024 on the connector position assurance member 102, and the elastic holding portion 1024 is elastically deformed towards the interior of the channel 1032 and moves out of the limiting portion 1034. Next, an operator pushes the connector position assurance member 102 in a direction along the channel of the beam portion 1036, such that the elastic holding portion 1024 is snapped into the bottom avoidance portion of the channel 1032. At this moment, the locking edge 1021 on one side of the connector position assurance member 102 abuts against the locking portion 1012, thereby locking the locking lever 103 in the second position.

According to the present invention, the connector position assurance member 102 is substantially entirely accommodated in the channel 1032 of the lever, with the position where the locking edge 1021 of the connector position assurance member 102 is in contact with the locking portion 1012 being also in the channel 1032 of the beam portion 1036 of the locking lever 103. Therefore, the connector has a compact structure without increasing the peripheral size thereof.

In the present invention, both ends of the channel 1032 of the locking lever 103 are open, with the mounting hole, the limiting portion 1034 and the avoidance portion 1035 therein being all symmetrically arranged with respect to the center line of the channel 1032, and the trigger protrusions 1011 being also symmetrically arranged on the housing of the connector. In this way, the connector position assurance member 102 can be optionally inserted from either end of the channel 1032, and one corresponding trigger protrusions 1011 on the housing 101 can abut against the elastic holding portion 1024 on the bottom side of the connector position assurance member 102 so as to trigger the movement of the connector position assurance member 102 from the pre-installed position to the locked position. The flexibility of installation of the connector position assurance member 102 is greatly improved. Especially in a narrow space, such as in a vehicle, using the electrical connector according to the present invention, the direction of insertion of the connector position assurance member 102 can be changed at will according to the actual use environment of the electrical connector.

Both the trigger protrusions 1011 and the locking portion 1012 are received inside the channel 1032, which is thus possible to avoid the failure of these parts due to accidental touch.

The present invention has been disclosed above in terms of several embodiments which, however, are not intended to limit the present invention, and any person skilled in the art could make possible changes and alterations without departing from the spirit and scope of the present invention. Hence, any alterations, equivalent changes and modifications which are made to the above-mentioned embodiments in accordance with the technical substance of the present invention and without departing from the content of the technical solutions of the present invention, will fall within the scope of protection defined by the claims of the present invention.

The invention claimed is:

1. An electrical connector, comprising:

a housing provided with a locking portion;

a locking lever pivotally mounted on the housing, the locking lever pivoting between a first position and a second position, and the locking lever having a first arm and a second arm connected to opposite sides of the housing and a beam portion extending between the first arm and the second arm, with a channel being provided in the beam portion, wherein the channel has a top, a bottom, and two open side ends; and a connector position assurance member, the connector position assurance member having a locking edge, the connector position assurance member being inserted into the channel from an open end of the channel, and the connector position assurance member having a pre-installed position and a locked position in the channel, wherein the connector position assurance member is optionally inserted from either of the two open side ends, wherein when the locking lever pivots to the second position and the connector position assurance member enters into the locked position, the locking edge abuts against the locking portion in the channel, thereby locking a rotational motion of the locking lever.

2. The electrical connector of claim 1, wherein the bottom of the channel has an opening, and when the locking lever pivots to the second position, the locking portion is received into the channel through the opening.

3. The electrical connector of claim 1, wherein the connector position assurance member has two locking edges arranged in an opposite manner, each of the locking edges comprises a notch, and when the connector position assurance member is in the pre-installed position in the channel, one of the notches is aligned with the locking portion and receives the locking portion.

4. The electrical connector of claim 1, wherein a top side of the connector position assurance member has a mounting portion, and the top of the channel is provided with a mounting hole that engages with the mounting portion.

5. The electrical connector of claim 1, wherein a bottom side of the connector position assurance member is provided with an elastic holding portion; and the bottom of the channel has a limiting portion and an avoidance portion, when the connector position assurance member is in the pre-installed position, the elastic holding portion fits into the limiting portion, and when the connector position assurance member moves to the locked position, the elastic holding portion fits into the avoidance portion.

6. The electrical connector of claim 5, wherein the housing is provided with a trigger protrusion, when the locking lever with the connector position assurance member rotates to the second position and the connector position assurance member is in the pre-installed position, the trigger protrusion is received into the limiting portion and abuts against the elastic holding portion, such that the elastic holding portion moves out of the limiting portion.

7. The electrical connector of claim 6, wherein the housing is provided with two trigger protrusions, and the two trigger protrusions are symmetrically arranged with respect to the locking portion.

8. The electrical connector of claim 5, wherein two avoidance portions are provided, the avoidance portions are symmetrically arranged on two sides of the limiting portion with respect to the limiting portion, and the avoidance portions and the limiting portion are arranged on a straight line.

9. The electrical connector of claim 1, wherein one end of the connector position assurance member is provided with a tab as an operation portion.

10. An electrical connector, comprising:

a housing provided with a locking portion;

a locking lever pivotally mounted on the housing, the locking lever pivoting between a first position and a second position, and the locking lever having a first arm and a second arm connected to opposite sides of the housing and a beam portion extending in a lateral direction between the first arm and the second arm, with a channel being provided in the beam portion, wherein the channel extends in the lateral direction and is open on at least one side end; and a connector position assurance member, the connector position assurance member having a locking edge, the connector position assurance member being inserted into the channel from an open end of the channel, and the connector position assurance member having a pre-installed position and a locked position in the channel, wherein the connector position assurance member is inserted into the channel via the opening on the at least one side end, wherein when the locking lever pivots to the second position and the connector position assurance member enters into the locked position, the locking edge abuts against the locking portion in the channel, thereby locking a rotational motion of the locking lever.

11. The electrical connector of claim 10, wherein the channel has a top and a bottom, wherein the bottom of the channel has an opening, and when the locking lever pivots to the second position, the locking portion is received into the channel through the opening.

12. The electrical connector of claim 10, wherein the connector position assurance member has two locking edges arranged in an opposite manner, each of the locking edges comprises a notch, and when the connector position assurance member is in the pre-installed position in the channel, one of the notches is aligned with the locking portion and receives the locking portion.

13. The electrical connector of claim 10, wherein a top side of the connector position assurance member has a mounting portion, and the top of the channel is provided with a mounting hole that engages with the mounting portion.

14. The electrical connector of claim 10, wherein a bottom side of the connector position assurance member is provided with an elastic holding portion; and the bottom of the channel has a limiting portion and an avoidance portion, when the connector position assurance member is in the pre-installed position, the elastic holding portion fits into the limiting portion, and when the connector position assurance member moves to the locked position, the elastic holding portion fits into the avoidance portion.

15. The electrical connector of claim 14, wherein the housing is provided with a trigger protrusion, when the locking lever with the connector position assurance member rotates to the second position and the connector position assurance member is in the pre-installed position, the trigger protrusion is received into the limiting portion and abuts against the elastic holding portion, such that the elastic holding portion moves out of the limiting portion.

16. The electrical connector of claim 15, wherein the housing is provided with two trigger protrusions, and the two trigger protrusions are symmetrically arranged with respect to the locking portion.

17. The electrical connector of claim 14, wherein two avoidance portions are provided, the avoidance portions are symmetrically arranged on two sides of the limiting portion with respect to the limiting portion, and the avoidance portions and the limiting portion are arranged on a straight line.

18. The electrical connector of claim 10, wherein one end of the connector position assurance member is provided with a tab as an operation portion.

* * * * *